United States Patent [19]

Dongas

[11] Patent Number: 4,865,236

[45] Date of Patent: Sep. 12, 1989

[54] GARMENT HANGER

[75] Inventor: Alexander Dongas, Marrickville, Australia

[73] Assignee: Pro Plast Pty. Limited, Marrickville, Australia

[21] Appl. No.: 142,939

[22] Filed: Jan. 12, 1988

[30] Foreign Application Priority Data

Jan. 13, 1987 [AU] Australia ..... PH09857

[51] Int. Cl.[4] ..... A47G 25/16; A47G 25/36

[52] U.S. Cl. ..... 223/88; 223/92; 40/322; D6/318; D6/319

[58] Field of Search ..... 223/85, 88, 92; D6/318, D6/319; 40/322

[56] References Cited

U.S. PATENT DOCUMENTS

D. 272,502 2/1984 Batts et al. ..... D6/319

*Primary Examiner*—Robert R. Mackey

*Attorney, Agent, or Firm*—Christie, Parker & Hale

[57] ABSTRACT

A clothing hanger formed of a synthetic plastic material and comprising a body portion adapted to support articles of clothing and a hook portion by which the hanger may be supported. The body portion comprises a pair of arms each of which has a cross sectional configuration having a non-central neutral axis. Each arm includes a pair of, spaced apart, first webs positioned on the neutral axis, a second web displaced on one side of the neutral axis, a pair of connecting webs one of which connects the second web with each of the first webs extending from each end of the second web towards and through the neutral axis, and flanges extending transversely of the first webs on both sides of the neutral axis. The hangers according to the invention are lighter and stronger than prior art hangers and may be produced more rapidly than such prior art hangers.

9 Claims, 3 Drawing Sheets

GARMENT HANGER

FIELD OF THE INVENTION

The present invention relates to a clothing hanger formed of a synthetic plastic material characterized by the cross sectional configuration of the body of the hanger.

BACKGROUND OF THE INVENTION

It is known from Australian patent specification 544211 to provide a moulded plastic clothing hanger with arms with a cross sectional configuration having a substantially central neutral axis, at least two webs displaced laterally on either side of the neutral axis, at least one connecting web, and two flanges extending from the displaced webs towards and through the neutral axis. This known design is arranged to take advantage of the structural engineering principle that corrugated structures are strongest when the largest amount of material is furthest away from the neutral axis.

The present invention has surprisingly found that by forming a moulded plastic clothing hanger with an off-center neutral axis and with at least two, spaced apart, webs positioned on that neutral axis and one web displaced from it a stronger garment hanger can in fact be produced using slightly less plastic material than the abovementioned prior art garment hanger. Importantly, it has also been found that the hanger according to the present invention requires a slightly shorter cycle time in injection moulding machines than the prior art garment hangers. Garment hangers of the type to which the present invention relates are produced in extremely large numbers and even small savings in materials and cycle time can be of considerable economic significance.

SUMMARY OF THE INVENTION

The present invention consists in a clothing hanger formed of a synthetic plastic material, comprising a body portion adapted to support articles of clothing and a hook portion by which the hanger may be suspended, characterized in that the body portion comprises a pair of arms each of which has a cross-sectional configuration having a non-central vertical neutral axis, at least two, spaced apart, first webs positioned on the neutral axis, a second web displaced to one side of the neutral axis intermediate the webs positioned on the neutral axis, connecting webs connecting the second web with each of the first webs extending from each end of the second web toward and through the neutral axis, and flanges extending transversely of the first webs on both sides of the neutral axis.

In a preferred embodiment of the present invention the flanges extend substantially parallel to the connecting webs. In a further preferred embodiment, the hook portion of the hanger is provided with a tally which extends from the hook such that coding means can be attached to the hook. Optionally, the body portion is provided with a bar which runs between the ends of the body portion.

If desired, any one or more of the first or second webs may be provided with an additional stiffening rib or ribs. In one preferred embodiment of the invention, the second web is provided with a stiffening rib or ribs extending towards and through the neutral axis. In another preferred embodiment, each of the first webs is provided with stiffening ribs extending transversely of thereof on both sides of the neutral axis, such stiffening ribs being additional to the flanges on the first webs.

DRAWINGS

In order that the nature of the present invention may be better understood, preferred forms thereof are hereinafter described with reference to the accompanying drawings in which.

DETAILED DESCRIPTION

Figure 1:
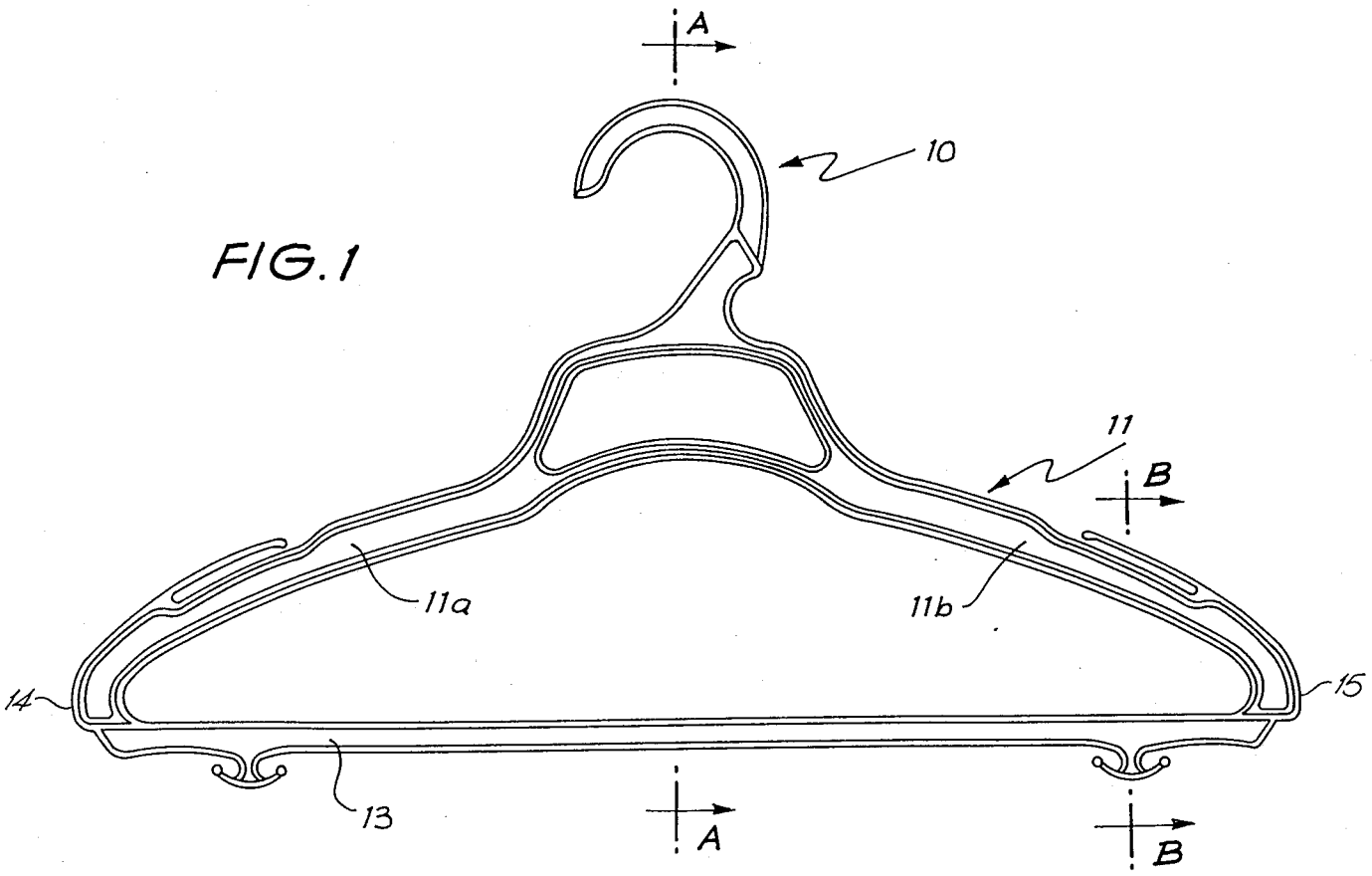
FIG. 1 is an elevational view of a preferred form of the clothing hanger of the presentinvention.

FIG. 1 shows a clothing hanger of the present invention comprising a hook portion 10 and a body portion 11 comprising a pair of arms 11*a* and 11*b*. A bar 13 extends between the ends 14 and 15 of the arms 11*a* and 11*b* of the body portion 11.

Figure 3:
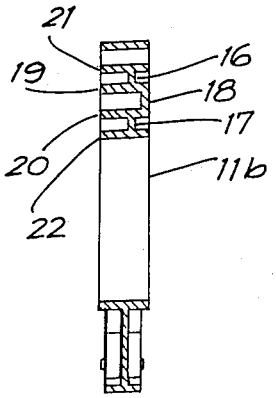
FIG. 3 is an enlarged cross-sectional view through line B—B of FIG. 1.

As is shown in FIG. 3, the cross-sectional configuration of the body portion 11 of the embodiment of the invention shown in FIG. 1 comprises first webs 16 and 17 positioned on the neutral axis and a second web 18 displaced from the neutral axis. Webs 16 and 17 are connected to the second web 18 by connecting webs 19 and 20 which extend from the ends of second web 18 through the neutral axis and across the width of the cross-section. Also provided are flanges 21 and 22 whih extend perpendicular to webs 16 and 17, respectively, through the neutral axis and across the width of the body portion 11, thereby providing a flat surface on the uppermost and lowermost surfaces of the body portion 11.

As is shown in FIG. 3, toward the central region of the body portion 11, the cross-sectional configuration further comprises additional webs 23 and 24 positioned on the neutral axis and stiffening ribs 25 and 26 extending perpendicular to webs 23 and 24, respectively, through the neutral axis and across the width of the body portion 11.

Figure 2:
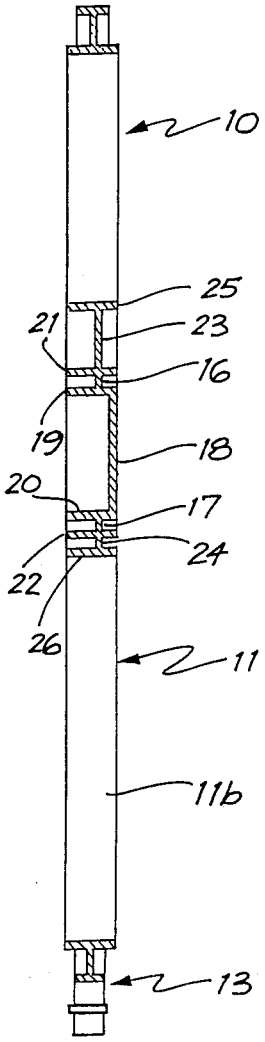
FIG. 2 is an enlarged cross-sectional view through line A—A of FIG. 1.
Figure 5:
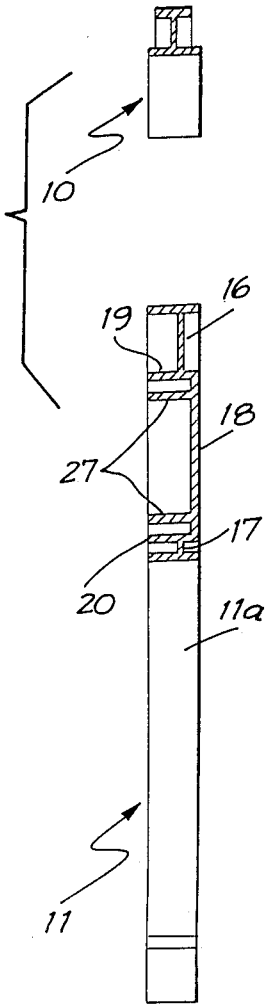
FIG. 5 is an enlarged cross sectional view through line C—C of FIG. 4.
Figure 4:
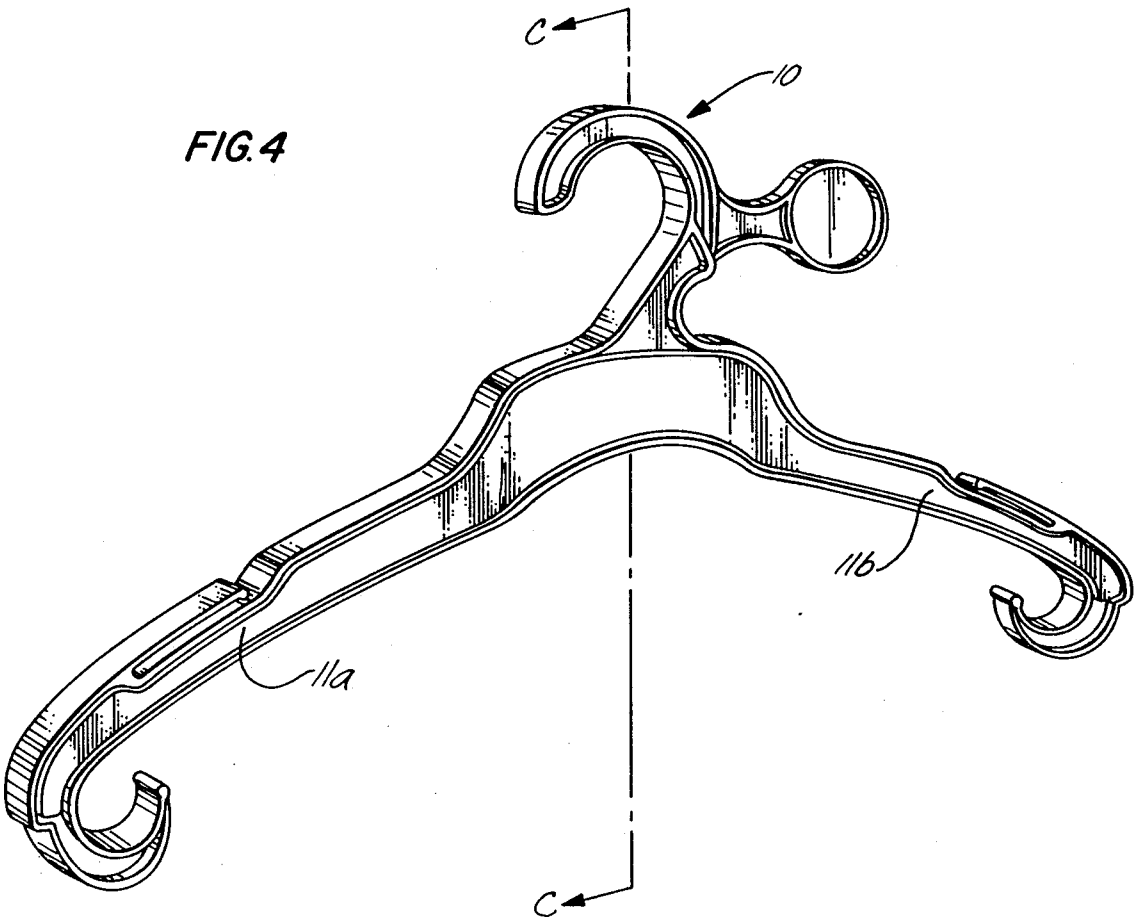
FIG. 4 is a perspective view of another preferred form of the clothing hanger of the present invention.

FIG. 4 shows a clothing hanger according to the present invention in which the body 11 comprises a pair of arms 11*a* and 11*b* which are not joined by a bar, such as the bar 13 of FIG. 1. As is seen in FIG. 5, the cross sectional configuration of the body 11 of the hanger of FIG. 4 differs from that of FIG. 2 in that stiffening ribs 27 are provided on the second web 18 rather than on the first webs 16 and 17. According to this embodiment of the invention, the cross sectional configuration of the body portion 11 comprises first webs 16 and 17 positioned on the neutral axis and a second web 18 displaced from the neutral axis. Webs 16 and 17 are connected to the second web 18 by connecting webs 19 and 20 which extend from the ends of the second web 18 through the neutral axis and across the width of the cross section. Also provided is an annular flange which extends perpendicularly to web 18 through the neutral axis and across the width of the body portion 11, thereby increasing the rigidity of the web 18.

I claim:

1. A clothing hanger formed of a synthetic plastic material, comprising a body portion adapted to support articles of clothing and a hook portion by which the hanger may be suspended, characterized in that the body portion comprises a pair of arms each of which has a cross-sectional configuration having a non-central vertical neutral axis, at least two, spaced apart, first webs positioned on the neutral axis, a second web displaced to one side of the neutral axis intermediate the webs positioned on the neutral axis, connecting webs connecting the second web with each of the first webs extending from each end of the second web toward and through the neutral axis, and flanges extending transversely of the first webs on both sides of the neutral axis.

2. A clothing hanger as claimed in claim 1 in which the first and second webs lie in parallel planes.

3. A clothing hanger as claimed in claim 1 in which the connecting webs and the flanges extend substantially perpendicularly to the first webs.

4. A clothing hanger as claimed in claim 1 in which at least one of the first and second webs is provided with at least an additional stiffening rib.

5. A clothing hanger as claimed in claim 4 in which the stiffening rib extends towards and through the neutral axis.

6. A clothing hanger as claimed in claim 4 in which the first webs are provided with stiffening ribs extending on each side of the neutral axis.

7. A clothing hanger as claimed in claim 1 in which the hook portion of the hanger is provided with a tally which extends from the hook such that coding means can be attached to the hook.

8. A clothing hanger as claimed in claim 1 in which the free ends of the arms of the body of the hanger are interconnected by a bar.

9. A clothing hanger as claimed in claim 1 in which the first and second webs each have an additional stiffening rib.

* * * * *